US007765839B2

(12) United States Patent
Chung

(10) Patent No.: US 7,765,839 B2
(45) Date of Patent: Aug. 3, 2010

(54) DRUM TYPE WASHER AND DOOR

(75) Inventor: Young Suk Chung, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 351 days.

(21) Appl. No.: 12/071,407

(22) Filed: Feb. 20, 2008

(65) Prior Publication Data

US 2008/0302141 A1 Dec. 11, 2008

(30) Foreign Application Priority Data

Jun. 5, 2007 (KR) ..... 10-2007-0054984

(51) Int. Cl.
*D06F 39/14* (2006.01)

(52) U.S. Cl. ..... 68/196

(58) Field of Classification Search ..... 68/196
See application file for complete search history.

(56) References Cited

U.S. PATENT DOCUMENTS

2005/0262887 A1* 12/2005 Kim et al. ..... 68/196
2008/0028804 A1 2/2008 Hoppe et al.

FOREIGN PATENT DOCUMENTS

| | | |
|---|---|---|
| DE | 10 2005 023445 | 11/2006 |
| EP | 0 293 984 | 12/1988 |
| EP | 1 386 994 | 2/2004 |
| EP | 1 884 585 | 2/2008 |
| WO | 2006/122841 | 11/2006 |

OTHER PUBLICATIONS

Extended European Search Report issued Sep. 18, 2008 in corresponding European Patent Application No. 08152137.9.

* cited by examiner

*Primary Examiner*—Michael Cleveland
*Assistant Examiner*—Samuel A Waldbaum
(74) *Attorney, Agent, or Firm*—Staas & Halsey LLP

(57) ABSTRACT

A drum type washer and a door thereof are provided to eliminate moisture inside a door glass using natural convection. The door of the drum type washer includes a door glass, an inner door having a holder integral to the inner door to support an outer surface of the door glass, an outer door having a support rib integral to the outer door to support an inner surface of the door glass, the support rib including a hole set formed in the support rib such that an inside of the door glass communicates with an exterior of the drum type washer. With this configuration, the moisture created inside the door glass can be rapidly eliminated.

23 Claims, 6 Drawing Sheets

DRUM TYPE WASHER AND DOOR

CROSS-REFERENCE TO RELATED APPLICATIONS

This application claims the benefit of Korean Patent Application No. 10-2007-0054984, filed on Jun. 5, 2007, in the Korean Intellectual Property Office, the disclosure of which is incorporated herein by reference.

BACKGROUND

1. Field

The present invention relates to a door for a drum type washer. More particularly, to a drum type washer and its door capable of eliminating moisture inside a door glass.

2. Description of the Related Art

A washer mainly employs an electric motor as a main power source, and carries out washing and rinsing of dirty clothes to separate dirt from the dirty clothes using a detergent and water as well as dewatering of the rinsed clothes. The washer includes an electric motor as a power unit, a mechanical drive that transmits energy to wash, a controller that controls a washing process, and feed and drain units that feed and drain water. This washer is generally classified into a cylinder type, an agitator type, and a pulsator type.

In the cylinder type, water, detergent and wash are put into a drum having several lifters, and then the drum is rotated about a horizontal axis at a low speed. Thereby, the wash is done by impact applied when the wash is raised and falls by the lifters. This cylinder type does little damage to the wash, and can use a small quantity of water. However, the cylinder type must heat the water using, for instance, an electric heater due to the weak washing force, thereby leading to the high consumption of electricity, a long washing time, and a high level of noise.

FIG. 1 is a perspective view illustrating an existing drum type washer.

The drum type washer includes a housing 1 representing an external appearance, an opening 3 through which wash is put or withdrawn at a front of the housing 1, and a door 5 that can open and close the opening 3. The door 5 is pivotably coupled to one side of the housing 1 through a hinge unit 2.

As illustrated in FIG. 1, the door 5 has an outer door 6 on an outer side thereof, an inner door 7 on an inner side thereof, and a door glass 8 coupled between the outer door 6 and the inner door 7. In this case, the inner door 7 is adapted to insert the door glass 8. Thus, after the door glass 8 is inserted into the inner door 7, the outer door 6 is coupled with the inner door 7. Thereby, the door glass 8 can be fixed to the door 5.

When the door 5 is closed, the outer door 6 represents the external appearance of the drum type washer. Hence, the outer door 6 is formed of a transparent material to show off a design of the drum type washer and simultaneously enable a user to observe an interior of a drum. Like the outer door 6, the door glass 8 is formed of a transparent material, for example, so that the user can look at the interior of the drum in the state where the door 5 is closed.

However, in the state where a part of the door glass 8 is inserted into the drum 4, the interior of the drum 4 frequently changes temperature and humidity, due to a supply of warm water or cold water, and an operation of a steam generator, a hot air blower, etc., and simultaneously the door glass 8 is influenced. In this manner, the change of the temperature and humidity in the drum 4 causes moisture to be generated inside the door glass 8, so that the external appearance of the drum type washer is damaged, and simultaneously the user cannot look at the interior of the drum 4.

SUMMARY

Accordingly, it is an aspect of the present embodiments to provide a drum type washer and a door thereof, capable of eliminating moisture inside a door glass using natural convection.

Additional aspects and/or advantages will be set forth in part in the description which follows and, in part, will be apparent from the description, or may be learned by practice of the invention.

The foregoing and/or other aspects are achieved by providing a door of a drum type washer, which includes a door glass, an inner door having a holder integral to the inner door to support an outer surface of the door glass, an outer door having a support rib integral to the outer door to support an inner surface of the door glass, the support rib including a hole set formed in the support rib such that an inside of the door glass communicates with an exterior of the drum type washer.

According to an aspect of the present embodiment, the holder includes an opening into which the door glass is inserted.

According to an aspect of the present embodiment, the door glass has a body inserted into the opening of the holder, and a wing integrally formed with the body supported on the holder.

According to an aspect of the present embodiment, the holder has a first curvature facing the wing, the wing has a second curvature facing the holder, the first curvature being engaged with the second curvature.

According to an aspect of the present embodiment, the support rib has an annular shape to support an inner surface of the wing.

According to an aspect of the present embodiment, the hole set is formed at an end of the support rib that faces the door glass.

According to an aspect of the present embodiment, the support rib includes a plurality of hole sets.

According to an aspect of the present embodiment, the hole set has a slot shape.

According to an aspect of the present embodiment, the hole set includes a first hole located above a central line of the support rib, and a second hole located below the central line of the support rib.

According to an aspect of the present embodiment, the first and second holes are spaced at a distance farthest apart from one another with respect to the central line of the support rib.

According to an aspect of the present embodiment, the hole set includes a first hole and a second hole, and perpendicular distances of the first hole and the second hole to the central line of the support rib are different from each other.

According to an aspect of the present embodiment, the first hole is located at a position corresponding to substantially 3 o'clock along the support rib, and the second hole is located at a position corresponding to approximately 11 o'clock along the support rib.

The foregoing and/or other aspects are achieved by providing a drum type washer, which includes a drum receiving laundry and being rotatable to wash the laundry; an inner door; a door glass inserted into and mounted on the inner door; and an outer door having a support rib closely contacting the door glass to fix the door glass together with the inner door, the support rib having a hole set defined through portions of the support rib; a first space defined between the outer door and the door glass; and a second space defined between the outer door and the inner door adjacent to the first space, the second space communicating with the first space through the hole set.

According to an aspect of the present embodiment, the inner door includes at least one vent such that the second space communicates with external air.

According to an aspect of the present embodiment, the hole set includes a first hole located above a central line of the support rib, and a second hole located below the central line of the support rib.

According to an aspect of the present embodiment, the first and second holes are spaced at a distance farthest apart from one another with respect to the central line of the support rib.

According to an aspect of the present embodiment, the hole set includes a first hole and a second hole, and perpendicular distances of the first hole and the second hole to the central line of the support rib are different from each other.

The foregoing and/or other aspects are achieved by providing a door of a drum type washer, including: an outer door; an inner door disposed adjacent the outer door; a door glass supported between the outer door and the inner door; a first space defined between the outer door and the door glass; and a second space defined between the outer door and the inner door adjacent to the first space, the second space communicating with the first space.

At least one hole may be defined in a portion of the outer door, the hole allowing the second space to communicate with the first space.

The outer door may include a support rib defining an opening, the hole being defined through the support rib.

The inner door may include a vent defined therethrough.

The door glass may include a wing disposed about an outer peripheral surface of the door glass, the inner door may include an opening and a holder disposed about an outer peripheral surface of the opening, the wing being disposed and held between the support rib of the outer door and the holder of the inner door.

The holder may include a first curvature, the wing may include a second curvature, the first curvature may abut against the second curvature, and the wing may be held between the outer door and the inner door at the abutting position of the first and second curvatures.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF THE EMBODIMENTS

Figure 1:
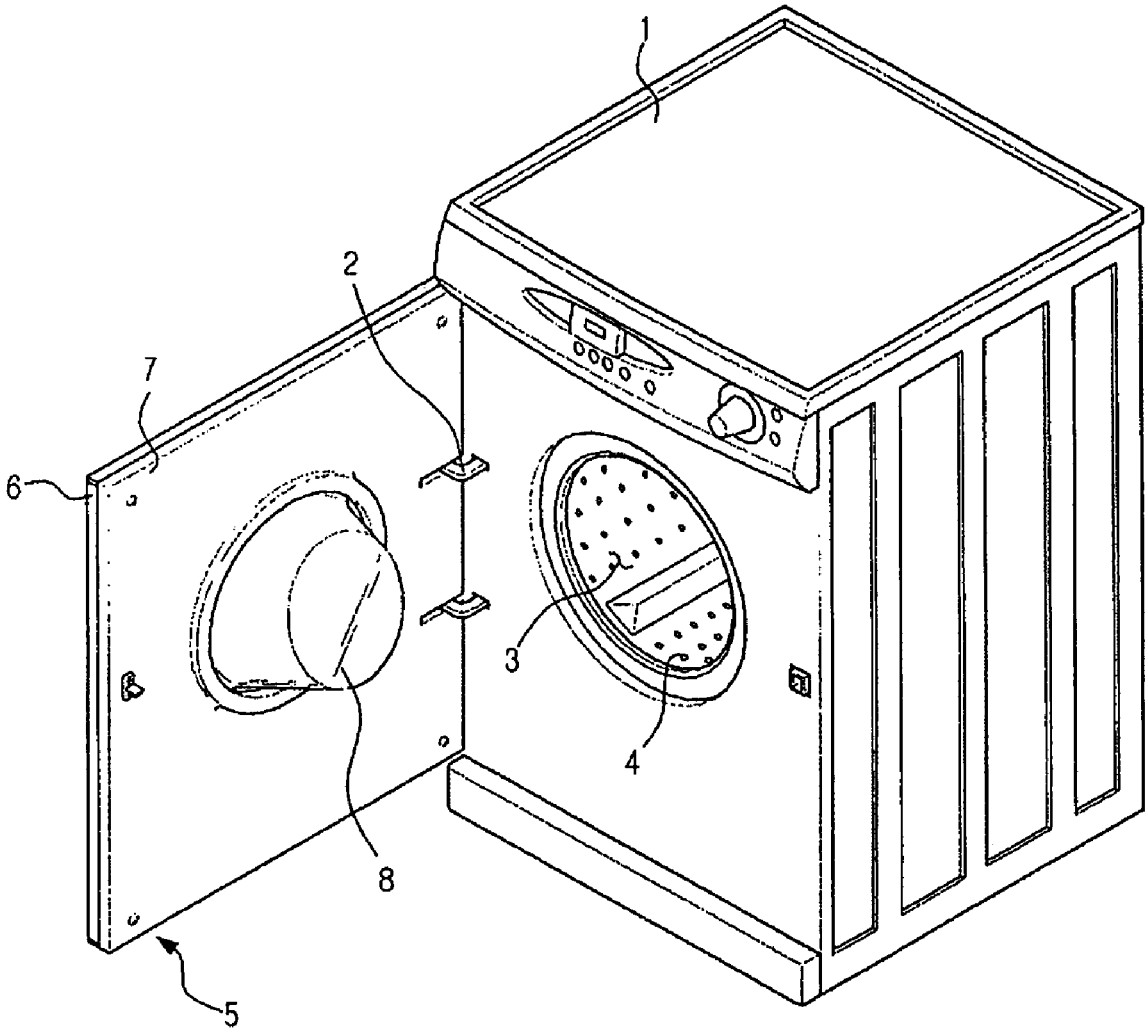
FIG. 1 is a perspective view illustrating an existing drum type washer.

Reference will now be made in detail to the embodiment, examples of which are illustrated in the accompanying drawings, wherein like reference numerals refer to the like elements throughout. The embodiment is described below to explain the present invention by referring to the figures.

Figure 2:
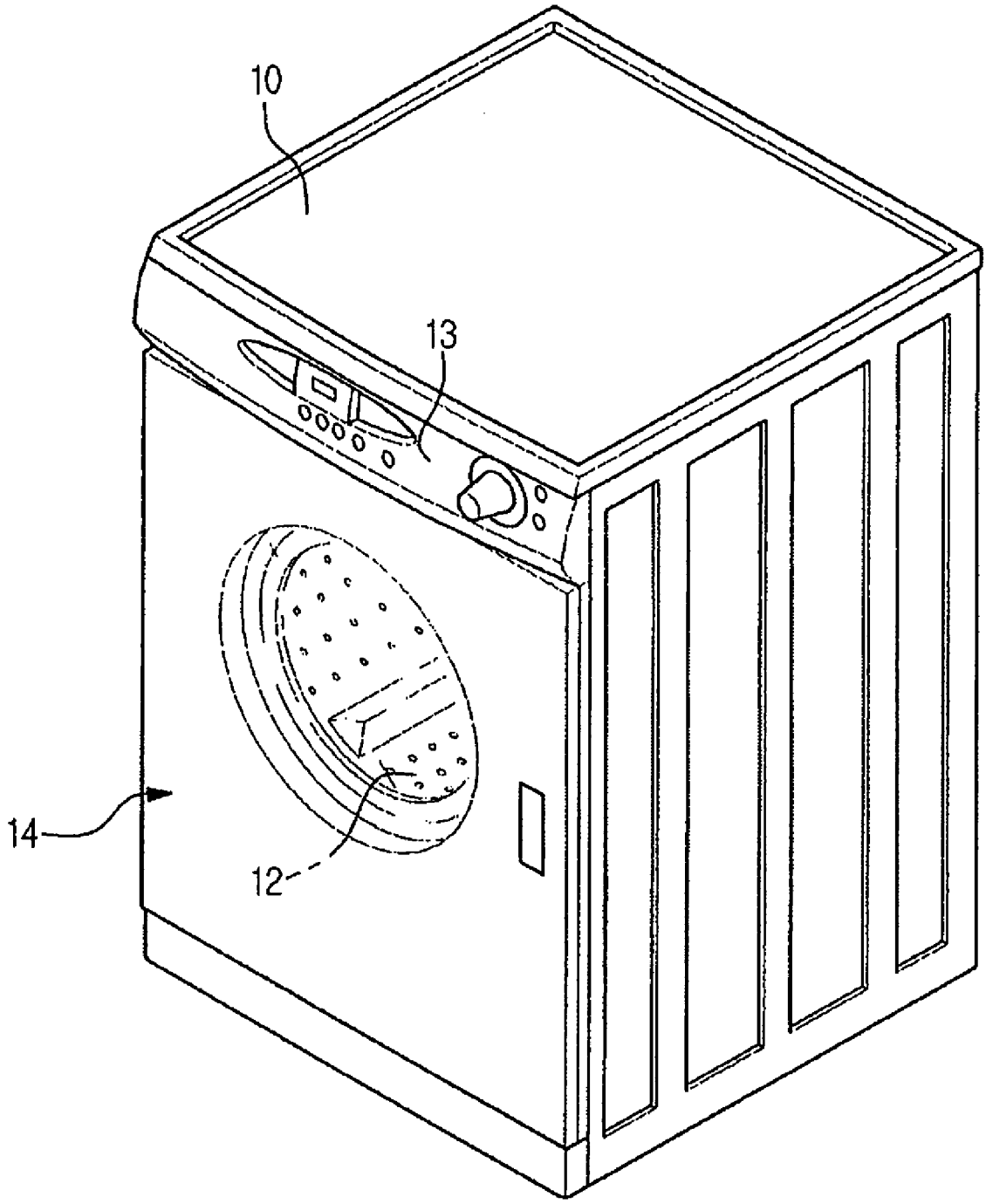
FIG. 2 is a perspective view illustrating a drum type washer according to an embodiment, in which a door is closed.

FIG. 2 is a perspective view illustrating a drum type washer according to an embodiment, in which a door is closed.

As illustrated in FIG. 2, the drum type washer includes a housing 10 representing an external appearance, a cylindrical tub (not shown) installed in the housing 10, a cylindrical drum 12 installed rotatably inside the tub and holding the wash, and a driving motor (not shown) generating a rotational force for the drum 12. The housing 10 is provided at an upper portion thereof with a control panel 13, which controls a washing method according to type and quantity of the wash. Further, the drum type washer further includes an opening 3 (see FIG. 1) in front of the housing 10 to be able to take the wash into or out of the drum, and a door 14 at the front of the housing 10 to be able to open and close the opening 3. The door 14 is pivotably coupled with the housing 10 through a hinge unit (not shown).

Figure 3:
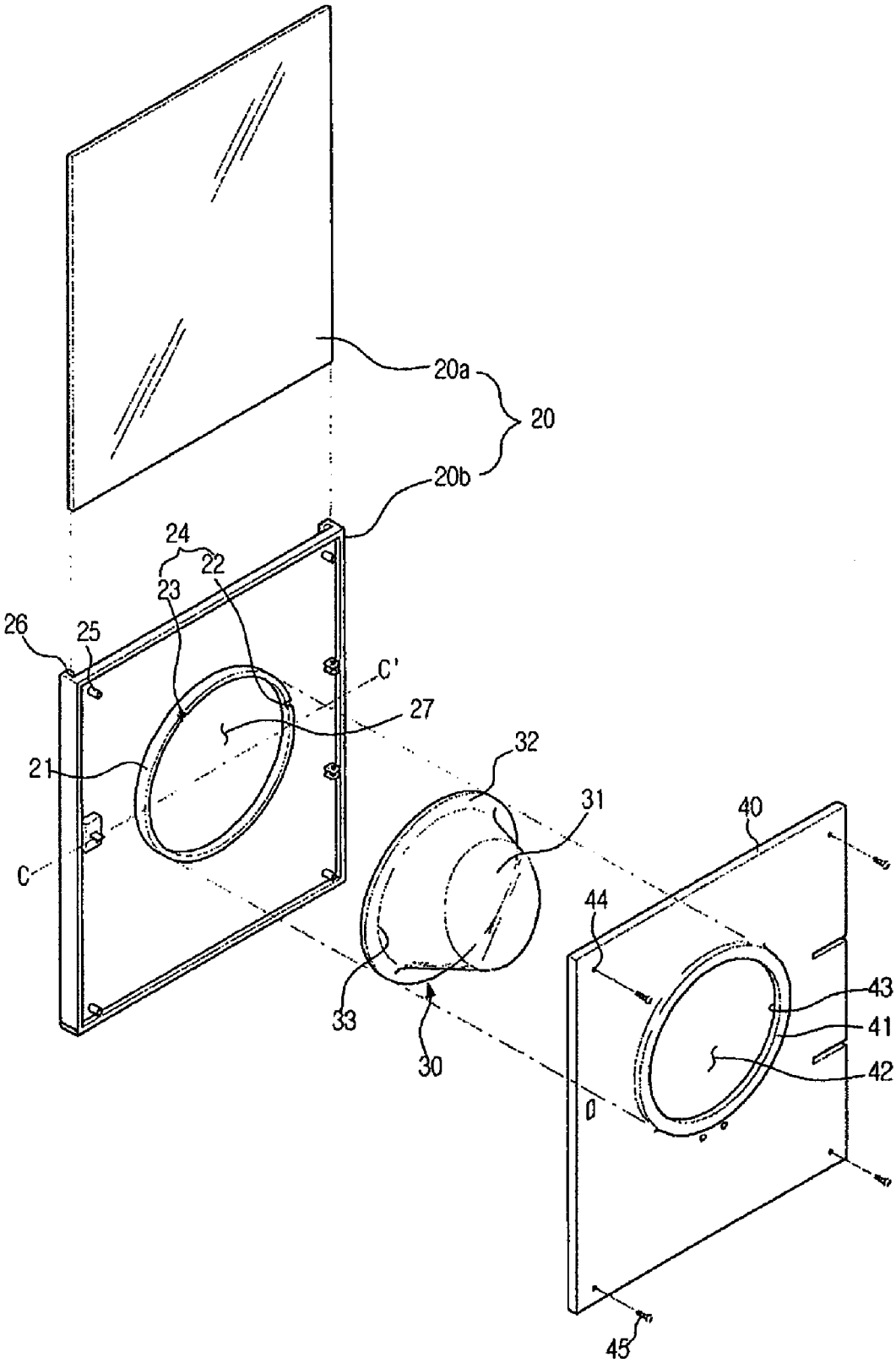
FIG. 3 is a disassembled perspective view illustrating the door of a drum type washer according to an embodiment.

FIG. 3 is a disassembled perspective view illustrating the door of a drum type washer according to an embodiment.

Figure 4:
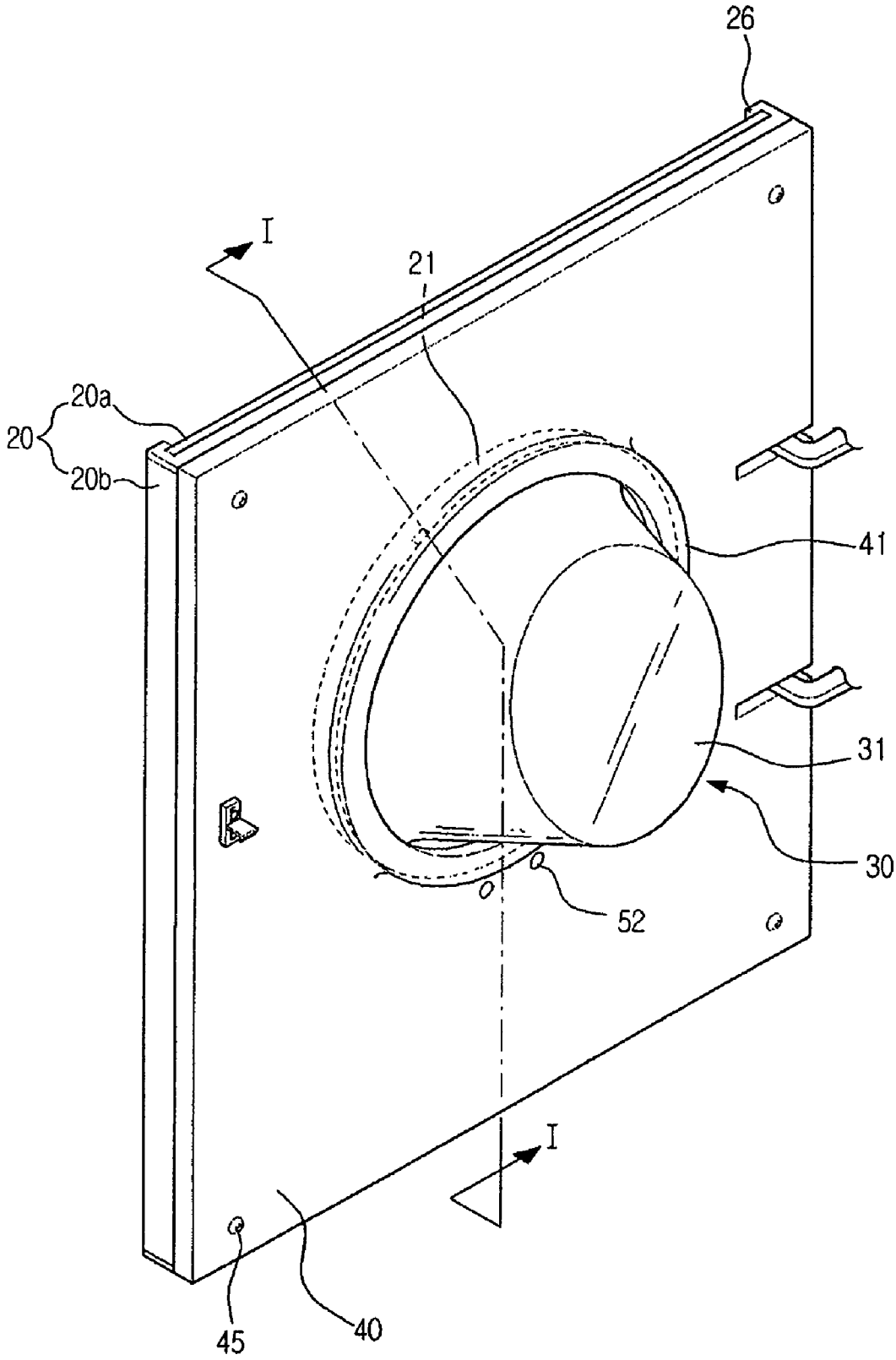
FIG. 4 is an assembled perspective view illustrating the door of a drum type washer according to an embodiment.

FIG. 4 is an assembled perspective view illustrating the door of a drum type washer according to an embodiment.

As illustrated in FIG. 3, the door 14 of the drum type washer includes an outer door 20 on an outer side thereof, an inner door 40 on an inner side thereof, and a door glass 30 fixed between the outer door 20 and the inner door 40.

The outer door 20 plays an important role in the beauty and aesthetic appearance of the drum type washer. Hence, the outer door 20 may be decorated with various designs. Further, the user must be able to look at the interior of the drum 12 (see FIG. 2) through the outer door 20. Thus, the outer door 20 includes a first outer door 20*a* that has a shape of a plate formed of a transparent material, and a second outer door 20*b* that fixes the first outer door 20*a* and is simultaneously coupled with the inner door 40.

Figure 5:
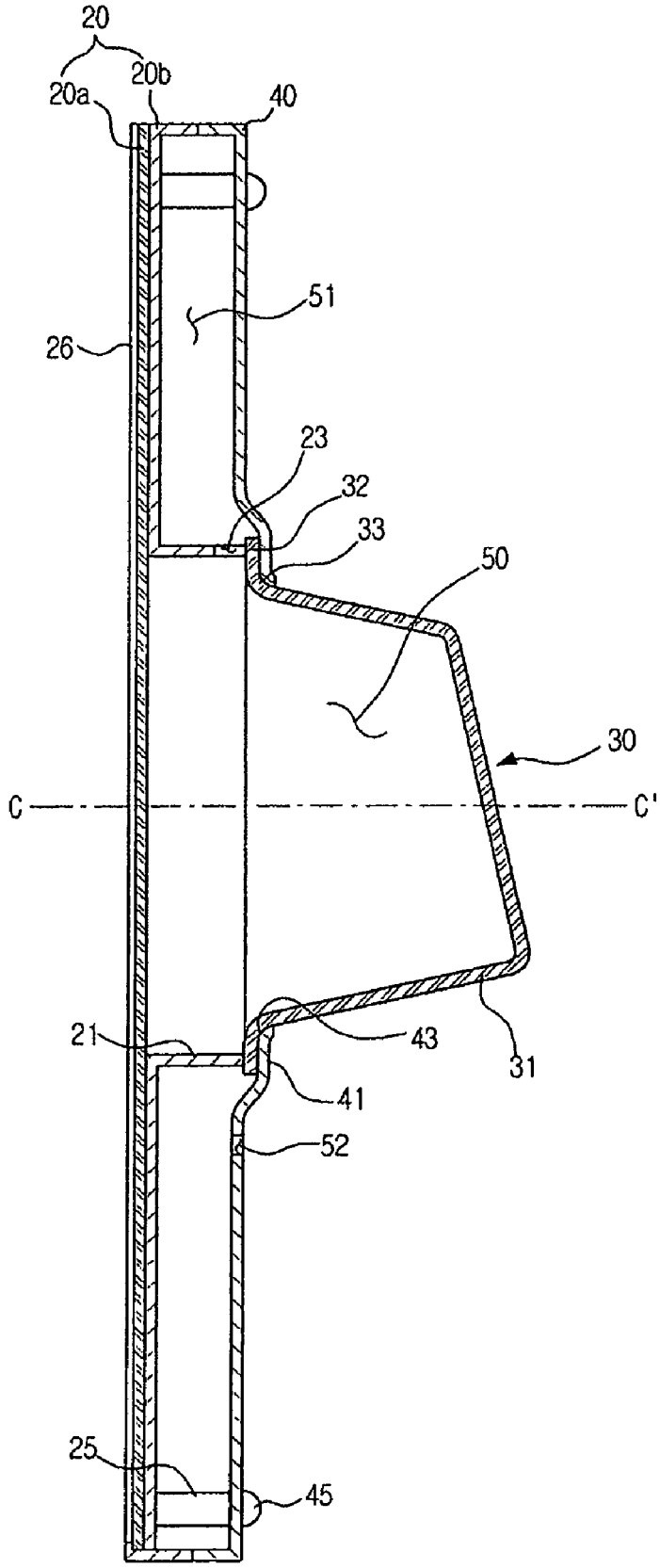
FIG. 5 is a sectional view taken along the line I-I' of FIG. 4.

The second outer door 20*b* includes catch jaws 26 to fix the first outer door 20*a* to the second outer door 20*b*. When the first outer door 20*a* is fixed to the second outer door 20*b* by the catch jaws 26, the first outer door 20*a* comes into close contact with the second outer door 20*b*, so that no gap exists between the first and second outer doors 20*a* and 20*b*. Thus, as illustrated in FIG. 5, moisture created within first space 50 defined within the door glass 30 does not escape between the first and second outer doors 20*a* and 20*b*.

Further, the second outer door 20*b* includes screw bosses 25 to be coupled with the inner door 40. Each screw boss 25 includes an internal thread on an inner surface thereof. When the second outer door 20*b* is coupled with the inner door 40, the door glass 30 can be fixed between the second outer door 20*b* and the inner door 40. To this end, a support rib 21 protrudes from the second outer door 20*b* to closely support the door glass 30. The second outer door 20*b* includes an opening 27, which is open by an amount of the circumference of the support rib 21. The support rib 21 has the shape of a ring to support a wing 32 of the door glass 30. Further, the support rib 21 includes a hole set 24 at an end thereof, which will be described below in detail.

As illustrated in FIG. 4, the inner door 40 is coupled with the outer door 20, thereby representing an external appearance of the door 14. Referring to FIG. 3, the inner door 40 includes screw holes 44 to be fastened to the outer door 20 by screws 45. The inner door 40 includes an opening 42 at a center thereof such that a body 31 of the door glass 30 is inserted therein, and a holder 41 disposed along an outer circumference of the opening 42 such that the wing 32 of the door glass 30 is supported when the door glass 30 is inserted into the opening 42. The holder 41 includes a first curvature 43 to be engaged with the wing 32 of the door glass 30, and the wing 32 includes a second curvature 33 to be engaged with the holder 41 when the door glass 30 is inserted into the opening 42. A vent 52, discussed later, is included at the inner door 40. As illustrated in FIG. 5, when the inner 40 and outer 20 doors of the door 14 of the drum type washer are coupled together, the first curvature 43 is engaged with the second curvature 33, so that the door glass 30 can be maintained in a firmly coupled state although vibration of the drum type washer is transmitted.

An assembled sequence of the door 14 of the drum type washer will be described with reference to FIG. 3. First, when the door glass 30 is inserted through the opening 42 of the inner door 40, the wing 32 of the door glass 30 is supported to the holder 41 of the inner door 40. The support rib 21 of the outer door 20 supports the wing 32 of the door glass 30, and simultaneously brings the wing 32 of the door glass 30 into close contact with the holder 41 of the inner door 40. Finally, the inner door 40 is fastened to the outer door 20 by the screws 45, and thereby the door glass 30 is fixed between the outer door 20 and the inner door 40. In FIG. 4, this coupled door 14 of the drum type washer is shown in a perspective view.

FIG. 5 is a sectional view taken along the line I-I' of FIG. 4.

As illustrated in FIG. 5, the support rib 21 of the outer door 20 supports the door glass 30 in close contact with the door glass 30, so that the first space 50 is defined between the outer door 20 and the door glass 30. Further, the outer door 20 is fastened to the inner door 40 by the screws 45, so that a second space 51 is defined between the outer door 20 and the inner door 40.

Typically, when the support rib 21 supports the door glass 30 in close contact with the door glass 30, the first space 50 is in a semi-sealed state. Hence, the first space 50 does not communicate with the second space 51, so that moisture inside the door glass 30 is not easily eliminated. In the present embodiment, however, an end of the support rib 21, which faces the door glass 30, includes the hole set 24 (shown in FIG. 3) to allow the first space 50 to communicate with the second space 51, so that the moisture inside the door glass 30 can be easily eliminated. More than one hole set 24 may be included in the support rib 21 and the hole set 24 may have a slot shape, for example. Further, the inner door 40 includes the vent 52 such that the second space 51 easily communicates with external air. As a result, the first space 50, the second space 51, and the outside are adapted to have good ventilation, so that the moisture inside the door glass 30 can be rapidly eliminated.

Figure 6:
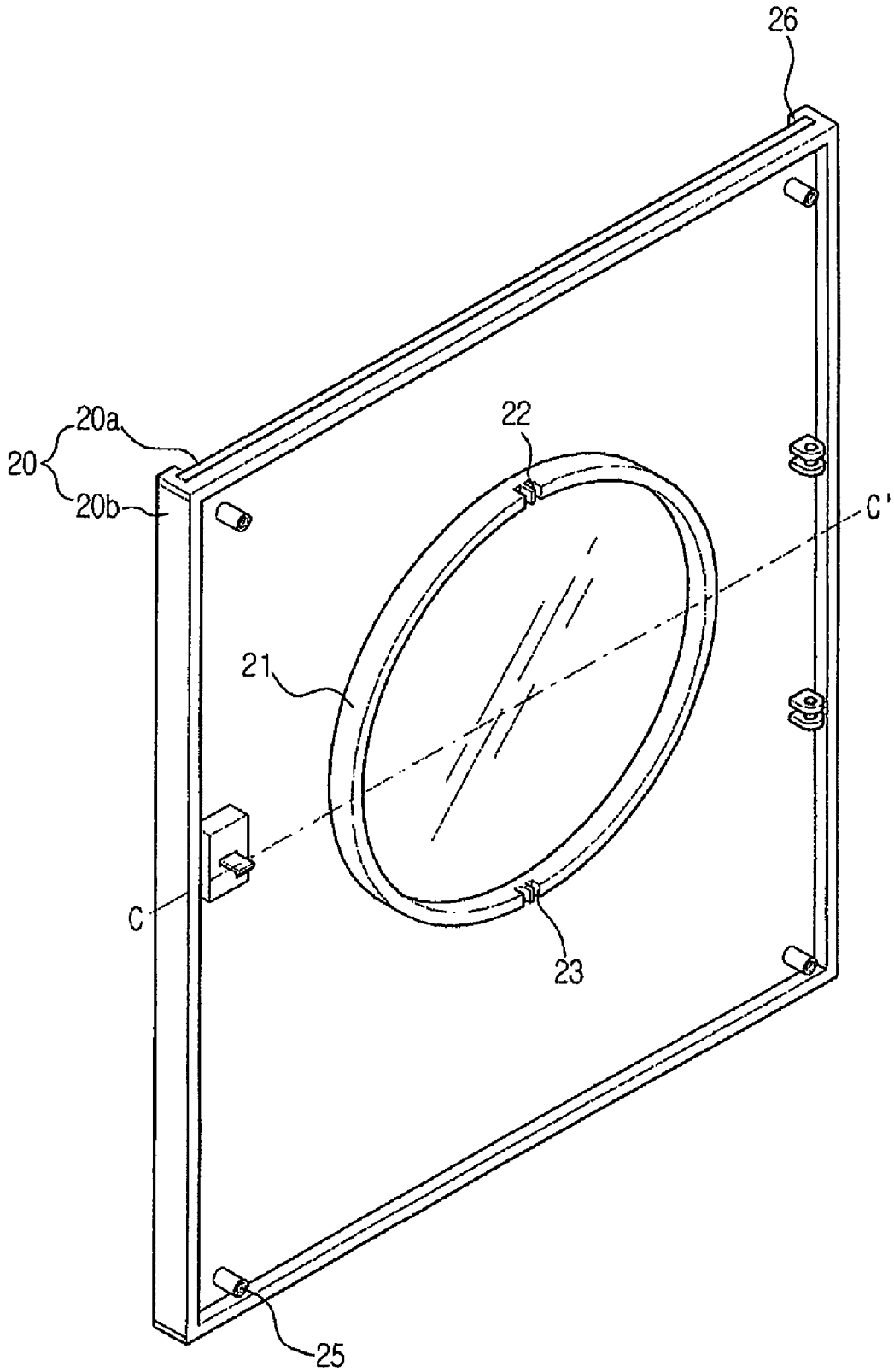
FIG. 6 is a perspective view illustrating an outer door of the doors of the drum type washer according to a second embodiment.

FIG. 6 is a perspective view illustrating an outer door of the doors of the drum type washer according to a second embodiment.

As illustrated in FIG. 6, the support rib 21 includes a plurality of holes 22 and 23 constituting the hole set 24. The first hole 22 of the hole set 24 is located above the central line C-C' of the support rib 21, and the second hole 23 is located below the central line C-C' of the support rib 21. Further, the first and second holes 22 and 23 are spaced apart from the central line C-C' of the support rib 21 to the greatest possible extent. In other words, the first hole 22 is located at approximately 12 o'clock along the support rib 21, and the second hole 23 is located at approximately 6 o'clock along the support rib 21.

As for the reason that the first and second holes 22 and 23 are formed as illustrated in FIG. 6, when moisture is present in the first space 50, a relative humidity is increased so that a density of the first space 50 is decreased. In this case, according to a stack effect, when the first hole 22 is formed at an uppermost end of the support rib 21, and when the second hole 23 is formed at a lowermost end of the support rib 21, a natural convection occurs most actively. In this case, the moisture inside the door glass 30 defining the first space 50 can be rapidly eliminated.

As illustrated in FIG. 2, however, when the user looks at the door 14 of the drum type washer or the interior of the drum 12, the eyes of the user are oriented from the topside to the downside. At this time, as illustrated in FIG. 6, if the second hole 23 is formed at the lowermost end of the support rib 21, the second hole 23 can be observed by the eyes of the user. For this reason, the user can misunderstand that the drum type washer is low in quality, and thus the satisfaction of consumers who prefer high-class products may be reduced. Thus, the first and second holes 22 and 23 may be located above the central line C-C' of the support rib 21, as shown in FIG. 3.

Further, as illustrated in FIG. 3, when the first and second holes 22 and 23 are formed, a perpendicular distance between the first hole 22 and the central line C-C' of the support rib 21 is preferably different from that between the second hole 23 and the central line C-C' of the support rib 21. As described above, this is because the natural convection is caused by a density difference, and thus, if the first hole 22 and the second hole 23 are located at the same height, natural convection does not occur smoothly. Hence, as illustrated in FIG. 3, the first hole 22 may be located at almost 3 o'clock along the support rib 21, and the second hole 23 is located at approximately 11 o'clock of the support rib 21.

This limitation to the positions of the first and second holes 22 and 23 is to make a compromise in order to meet both a requirement of increasing the user's aesthetic satisfaction of the external appearance of the product and a requirement of smoothly causing the natural convection, by way of an exemplary embodiment.

According to an embodiment, the moisture created inside the door glass can be rapidly eliminated.

Further, according to an embodiment, the user can clearly look at the interior of the drum through the outer door and the door glass, and cleanly maintain the beauty of the external appearance of the product.

Although few embodiments have been shown and described, it would be appreciated by those skilled in the art that changes may be made in these embodiments without departing from the principles and spirit of the invention, the scope of which is defined in the claims and their equivalents.

What is claimed is:

1. A door of a drum type washer, comprising:

a door glass;

an inner door having a holder to support an outer surface of the door glass;

an outer door having a support rib to support an inner surface of the door glass, the support rib including a hole set formed in the support rib such that an inside of the door glass communicates with an exterior of the door of the drum type washer.

2. The door according to claim 1, wherein the holder includes an opening into which the door glass is inserted.

3. The door according to claim 2, wherein the door glass has a body inserted into the opening of the holder and a wing integrally formed with the body supported on the holder.

4. The door according to claim 3, wherein: the holder has a first curvature facing the wing; and the wing has a second curvature facing the holder, the first curvature being engaged with the second curvature.

5. The door according to claim 3, wherein the support rib has an annular shape to support an inner surface of the wing.

6. The door according to claim 1, wherein the hole set is formed at an end of the support rib that faces the door glass.

7. The door according to claim 1, wherein the support rib includes a plurality of hole sets.

8. The door according to claim 1, wherein the hole set has a slot shape.

9. The door according to claim 1, wherein the hole set includes a first hole located above a central line of the support rib, and a second hole located below the central line of the support rib.

10. The door according to claim 9, wherein the first and second holes are spaced at a distance farthest apart from one another with respect to the central line of the support rib.

11. The door according to claim 1, wherein the hole set includes a first hole and a second hole, and perpendicular distances of the first hole and the second hole to the central line of the support rib are different from each other.

12. The door according to claim 11, wherein the first hole is located at a position corresponding to substantially 3 o'clock along the support rib, and the second hole is located at a position corresponding to approximately 11 o'clock along the support rib.

13. A drum type washer, comprising:

a drum receiving laundry and being rotatable to wash the laundry;

an inner door;

a door glass inserted into and mounted on the inner door;

an outer door having a support rib closely contacting the door glass to fix the door glass together with the inner door, the support rib having a hole set defined through portions of the support rib;

a first space defined between the outer door and the door glass; and a second space defined between the outer door and the inner door adjacent to the first space, the second space communicating with the first space through the hole set.

14. The drum type washer according to claim 13, wherein the inner door includes at least one vent such that the second space communicates with external air.

15. The drum type washer according to claim 13, wherein the hole set includes a first hole located above a central line of the support rib, and a second hole located below the central line of the support rib.

16. The drum type washer according to claim 15, wherein the first and second holes are spaced at a distance farthest apart from one another with respect to the central line of the support rib.

17. The drum type washer according to claim 13, wherein the hole set includes a first hole and a second hole, and perpendicular distances of the first hole and the second hole to the central line of the support rib are different from each other.

18. A door of a drum type washer, comprising:

an outer door;

an inner door disposed adjacent the outer door;

a door glass supported between the outer door and the inner door;

a first space defined between the outer door and the door glass; and a second space defined between the outer door and the inner door adjacent to the first space, the second space communicating with the first space.

19. The door according to claim 18, wherein at least one hole is defined in a portion of the outer door, the hole allowing the second space to communicate with the first space.

20. The door according to claim 19, wherein the outer door includes a support rib defining an opening, the hole being defined through the support rib.

21. The door according to claim 20, wherein the door glass includes a wing disposed about an outer peripheral surface of the door glass, the inner door includes an opening and a holder disposed about an outer peripheral surface of the opening, the wing being disposed and held between the support rib of the outer door and the holder of the inner door.

22. The door according to claim 21, wherein the holder includes a first curvature, the wing includes a second curvature, the first curvature abuts against the second curvature, and the wing is held between the outer door and the inner door at the abutting position of the first and second curvatures.

23. The door according to claim 18, wherein the inner door includes a vent defined therethrough.

* * * * *